US008186479B2

(12) United States Patent
Vieira

(10) Patent No.: US 8,186,479 B2
(45) Date of Patent: May 29, 2012

(54) ROOF SCAFFOLDING SYSTEM

(76) Inventor: James Schimes Vieira, Scranton, PA (US)

( * ) Notice: Subject to any disclaimer, the term of this patent is extended or adjusted under 35 U.S.C. 154(b) by 810 days.

(21) Appl. No.: 11/811,204

(22) Filed: Jun. 8, 2007

(65) Prior Publication Data

US 2008/0006481 A1 Jan. 10, 2008

Related U.S. Application Data

(60) Provisional application No. 60/812,573, filed on Jun. 9, 2006.

(51) Int. Cl.
*E04G 1/36* (2006.01)

(52) U.S. Cl. ..... 182/45; 182/129

(58) Field of Classification Search ..... 182/45, 182/129

See application file for complete search history.

(56) References Cited

U.S. PATENT DOCUMENTS 3,292,734 A * 12/1966 Swanberg ..... 182/45
4,078,633 A * 3/1978 Fahy ..... 182/82
4,558,764 A * 12/1985 Lorenz ..... 182/45
4,971,169 A 11/1990 Fruth
5,197,257 A * 3/1993 Nietling ..... 52/749.12
5,524,727 A 6/1996 Yennie, Jr.
5,638,917 A 6/1997 Vennen
5,664,391 A 9/1997 Bartholomew
5,829,549 A 11/1998 Flynn
5,865,410 A 2/1999 Horen
6,003,629 A * 12/1999 Cloutier et al. ..... 182/45
6,003,630 A 12/1999 Whalen
6,003,631 A 12/1999 Knauth
6,053,280 A 4/2000 Smith
6,220,390 B1 * 4/2001 Pike ..... 182/45
6,470,646 B1 * 10/2002 Bryant ..... 52/749.12
6,666,298 B2 12/2003 Volkman
6,840,350 B2 * 1/2005 Deal ..... 182/82
2002/0027043 A1 3/2002 Wisler
2007/0062761 A1 * 3/2007 Megna et al. ..... 182/45

FOREIGN PATENT DOCUMENTS

DE 3709441 A1 * 10/1988
JP 02115453 A * 4/1990

* cited by examiner

*Primary Examiner* — Alvin Chin Shue
(74) *Attorney, Agent, or Firm* — McCarter & English, LLP

(57) ABSTRACT

The disclosed scaffolding system utilizes elongated members/rails that define a rectangular, e.g., square, cross-section and are adapted to be joined relative to each other using a nesting sleeve or union. The elongated members/rails are thus routinely joined to each other in the field using pre-defined apertures and cooperative hitch pins. L-shaped rail-mounting brackets are typically mounted at "top" ends of the elongated members/rails, i.e., the ends of the elongated members/rails to be positioned at/adjacent the roof apex. The L-shaped rail-mounting brackets include a sleeve portion of rectangular/square cross-section that is adapted to cooperate with the elongated member/rail through a telescoping action, and appropriate pins/aperture alignment may be used for securement purposes.

4 Claims, 11 Drawing Sheets

ROOF SCAFFOLDING SYSTEM

CROSS-REFERENCE TO RELATED APPLICATIONS

The present applications claims the benefit of a provisional patent application entitled "Roof Scaffolding System" that was filed on Jun. 9, 2006 and assigned Ser. No. 60/812,573. The entire contents of the foregoing provisional patent application are incorporated herein by reference.

BACKGROUND

1. Technical Field

The present disclosure is directed to an advantageous scaffolding system and, more particularly, to a roof scaffolding system that is adapted for efficient assembly and adjustment. In addition, the disclosed roof scaffolding system facilitates roofing activities, e.g., shingling, below the scaffolding support rails, thereby enhancing the speed and efficiency of roofing jobs.

2. Background Art

Various scaffolding systems are disclosed in the literature. For example, U.S. Pat. No. 6,666,298 to Volkman discloses a scaffolding support that is designed to hang from the top of a wall. The hanging scaffolding support includes a wall securing assembly, a vertical support, a horizontal support, and a vertical safety rail support.

U.S. Pat. No. 4,971,169 to Fruth discloses a scaffolding system that includes a folding hanger and work frames, storable bumpers on the work frame for propping the scaffold off of a wall, and a hanger structure in the hanger frame for suspending the scaffold from the cap or upper header of a building wall. The scaffolding of the Fruth '169 patent may be mounted by hanging the scaffold from the header or cap and propping the scaffold off with storable bumpers. The scaffold may also be folded flat for storage and transportation.

U.S. Pat. No. 5,524,727 to Yennie, Jr., discloses a construction wall bracket that includes a vertical member having a pair of laterally and outwardly-extending stud engagement members which are adapted to rest against a vertical wall. A horizontal member having an angle bracket extends horizontally outward from the vertical member to support a plank or platform for use by a workman during construction efforts. A support brace is affixed to the vertical member for engagement to the top horizontal stud of a wall. A swing arm having a depending end tab and a pair of longitudinally-extending hinge members is pivotally attached to the support brace about a hinge pin. Upward pivotal rotation of the swing arm with respect to the support brace facilitates removal of the construction wall bracket during periods of non-use. A safety pin is engaged to the hinge members and against the support brace to prevent pivotal rotation of the swing arm with respect to the support brace during operational positioning and use of the Yennie construction wall bracket.

U.S. Pat. No. 5,638,917 to Vennen discloses a work platform system for use while working off the ground in new construction, particularly for installation of roof structures and upper floors where fall protection systems are required and for which no effective work platform systems are available. The Vennen system includes of frame members with brackets, clips and straps. The components are welded and/or bolted together. The Vennen brackets are attached to a partially-completed structure to establish a work platform for subsequent construction activities. Conventional scaffold planks and railings are used and the separate use of fall protection devices is unnecessary.

U.S. Pat. No. 5,664,391 to Bartholomew discloses a J-hook roof anchoring and securement assembly which includes a rope tie-off attachment point. The assembly also includes a hanging scaffold attachment apparatus to provide an attachment point for a hanging scaffold system which includes a vertical support post attached to a platform base and walk boards provided thereon. A vertical safety rail post contains angled brackets that mate with top and bottom portions of the walk boards. A securing rod is attached at one end to the safety rail post, is threaded through the walk boards, and is secured at a second end. The walk boards are held in clamping contact with the vertical support post by the use of the securing rod.

U.S. Pat. No. 5,829,549 to Flynn discloses a walkway system for roof, truss or elevated workers utilizing first and second longitudinally spaced-apart support assemblies for releasable attachment to a top of a building wall. Each assembly presents a depending support bar that extends along an exterior surface of the building wall. A horizontal support brace is attached to each depending support bar at a selected position. The horizontal support brace provides support for overlying boards of a walkway. A vertical post is attached to the free end of the horizontal support brace, the vertical post including a plurality of vertically spaced brackets for receiving spaced-apart hand rails. A series of hook-like brackets are releasably placed along the rails for positioning a reinforcing strut adjacent each hand rail. The Flynn walkway can be vertically offset from the top of the building wall as well as laterally extended therefrom.

U.S. Pat. No. 5,865,410 to Horen discloses a universal staging bracket that is supported on the sloping side of a steel ship by means of a base plate having key hole apertures which engage headed studs welded to the side of the ship. A support arm is pivotally mounted on the base plate for disposition in a horizontal position when the base plate is not vertically disposed. A support leg is pivotally mounted on the base plate for pivotal movement to accommodate complex curvatures in the side of the ship and a telescopic knee brace is pivotally connected at opposite ends between the support leg and the support arm. The pivotal connection between the support arm and knee brace includes a traveling nut on a threaded bolt that is rotatably supported by the support arm.

U.S. Pat. No. 6,003,630 discloses a scaffold system for removable attachment to a wall that includes a vertical support member, a horizontal support member, and an attaching bracket. The first end of the vertical support member is attached to the horizontal support member so that the vertical support member is substantially perpendicular to the horizontal support member. The attaching bracket extends from the horizontal support member substantially aligned with and parallel to the horizontal support member. The attaching bracket removably attaches the vertical support member and the horizontal support member to the wall.

U.S. Pat. No. 6,003,631 to Knauth discloses a wall supported scaffolding device for suspension and attachment to the upper portion of a wall panel, wherein the scaffolding device includes an inverted T-shaped vertical support member provided with a plurality of generally C-shaped brackets. The C-shaped brackets are dimensioned to pivotally receive the inboard ends of a cross piece member and an angled brace member. The outboard ends of the cross piece member and the brace member support a railing support unit. The intermediate portion of the cross piece member is provided with a locking bolt for preventing lateral displacement of a scaffold plank along the longitudinal axis and/or transverse to the longitudinal axis of the cross piece member.

U.S. Pat. No. 6,053,280 to Smith et al. discloses a deck support for hanging from a top plate of a wall in residential or other construction. An upright or leg provides support of the weight of the deck which is supported on a foot extending laterally from the leg. The foot may be provided with a climber attachment that secures the foot extending horizontally from the leg, and yet is readily adjustable without alignment, line-of-sight adjustment, removal or repositioning of pins. Adjustment may be done safely by a single user employing a single hand. Alignment and engagement are simple and automatic by the climber securing the foot to the leg. A hanger bracket may extend adjustably across the top plate of a wall to support the leg extending vertically therebelow. The hanger may be opened to release from a wall after construction has been finished around the hanger rendering it otherwise non-removable. The entire assembly may be collapsed, without separation of parts, for transportation and storage.

U.S. Patent Publication No. 2002/0027043 to Wisler discloses a wall jack unit for erecting scaffolding that includes a series of brackets for placement at the top of a wall and connects with a wall surface-engaging pole and truss support structure with a combination user platform for supporting a wood plank between at least two of the units. Each part has adjustable features which utilize hole-engaging connections so that a series of units can be joined or formulated on a variety of building or wall structures. The Wisler unit is made of a durable steel which is resistant to weather-related effects.

Despite efforts to date, a need remains for scaffolding systems that are durable, easily installed and adjusted, and useful for various roof projects. A need also remains for scaffolding systems that do not obscure or otherwise prevent access to roofing surfaces with the scaffolding system mounted with respect to a roof surface. These and other needs are satisfied by the roof scaffolding systems disclosed herein.

SUMMARY

The present disclosure is directed to an advantageous scaffolding system that facilitates assembly and adjustment. The disclosed scaffolding system utilizes elongated members/rails that define a rectangular, e.g., square, cross-section and are adapted to be joined relative to each other using a nesting sleeve or union. The elongated members/rails are thus routinely joined to each other in the field using pre-defined apertures and cooperative hitch pins. L-shaped rail-mounting brackets are typically mounted at "top" ends of the elongated members/rails, i.e., the ends of the elongated members/rails to be positioned at/adjacent the roof apex. The L-shaped rail-mounting brackets include a sleeve portion of rectangular/square cross-section that is adapted to cooperate with the elongated member/rail through a telescoping action, and appropriate pins/aperture alignment may be used for securement purposes.

Roof brackets are also provided for supporting platforms and the like. Positioning of the roof brackets is achieved through a telescoping action of a rectangular/square sleeve relative to the elongated members/rails. Pre-defined apertures may be used to facilitate positioning of roof bracket pairs in alignment on adjacent elongated members/rails. Multiple roof brackets may travel on each elongated member/rail, thereby permitting positioning of working materials.

In exemplary embodiments of the disclosed roof scaffolding system, roof mounting may be achieved without the use of nails. In addition, height adjustments are quickly and easily achieved. Indeed, once deployed, height adjustments may generally be effected in less than a minute. A space is generally defined between the rails and the roof surface/roof deck, based on the clearance established through interaction at the roof apex and upward spacing established by the nesting sleeves and/or mounting brackets. In addition, one or more wedge-shaped shims may be introduced between the roof surface and the rails, e.g., where the roof surface is warped, rotten and/or uneven, due to increase the clearance therebetween. For roof removal projects, i.e., "tear-offs", it is generally unnecessary to remove the scaffolding system prior to commencing the re-roofing process. Roofing activities may be effectively undertaken with the disclosed scaffolding system in place, including in regions below the disclosed rails.

The disclosed scaffolding system provides a modular design that facilitates various activities, including tear-offs and roof repairs. The disclosed scaffolding system may be employed with a host of roofing materials and various roof pitches. Exemplary embodiments of the disclosed roof scaffolding system are of light-weight construction, e.g., aluminum, and offer substantial strength/durability for scaffolding applications. Additional features, functions and advantages associated with the disclosed scaffolding system will be apparent from the description which follows, particularly when read in conjunction with the appended figures.

BRIEF DESCRIPTION OF THE FIGURES

To assist those of ordinary skill in the art in making and using the disclosed scaffolding systems, reference is made to the appended figures, wherein.

DESCRIPTION OF EXEMPLARY EMBODIMENT(S)

As shown in the accompanying figures, the disclosed scaffolding system generally includes at least two elongated members/rails that define a rectangular, e.g., square, cross-section. Two or more elongated members/rails are adapted to be joined relative to each other using nesting sleeve(s) or union(s), thereby extending the effective length of the elongated members/rails. In the field, two elongated members/ rails are joined to each other with a nesting sleeve/union using pre-defined apertures and cooperative hitch pins. L-shaped rail-mounting brackets are typically mounted at "top" ends of the elongated members/rails, i.e., the ends of the elongated members/rails to be positioned at/adjacent the roof apex. The L-shaped rail-mounting brackets include a sleeve portion of rectangular/square cross-section that is adapted to cooperate with the elongated member/rail through a telescoping action, and appropriate pins/aperture alignment may be used for securement purposes.

Roof brackets cooperate with the elongated members/rails to support work platforms and the like. Pre-defined apertures formed in the sleeve portion of each roof bracket may be used to facilitate positioning of roof bracket pairs in alignment on adjacent elongated members/rails. Multiple roof brackets may travel on each elongated member/rail, thereby permitting positioning of working materials in close proximity to workers.

Figure 1:
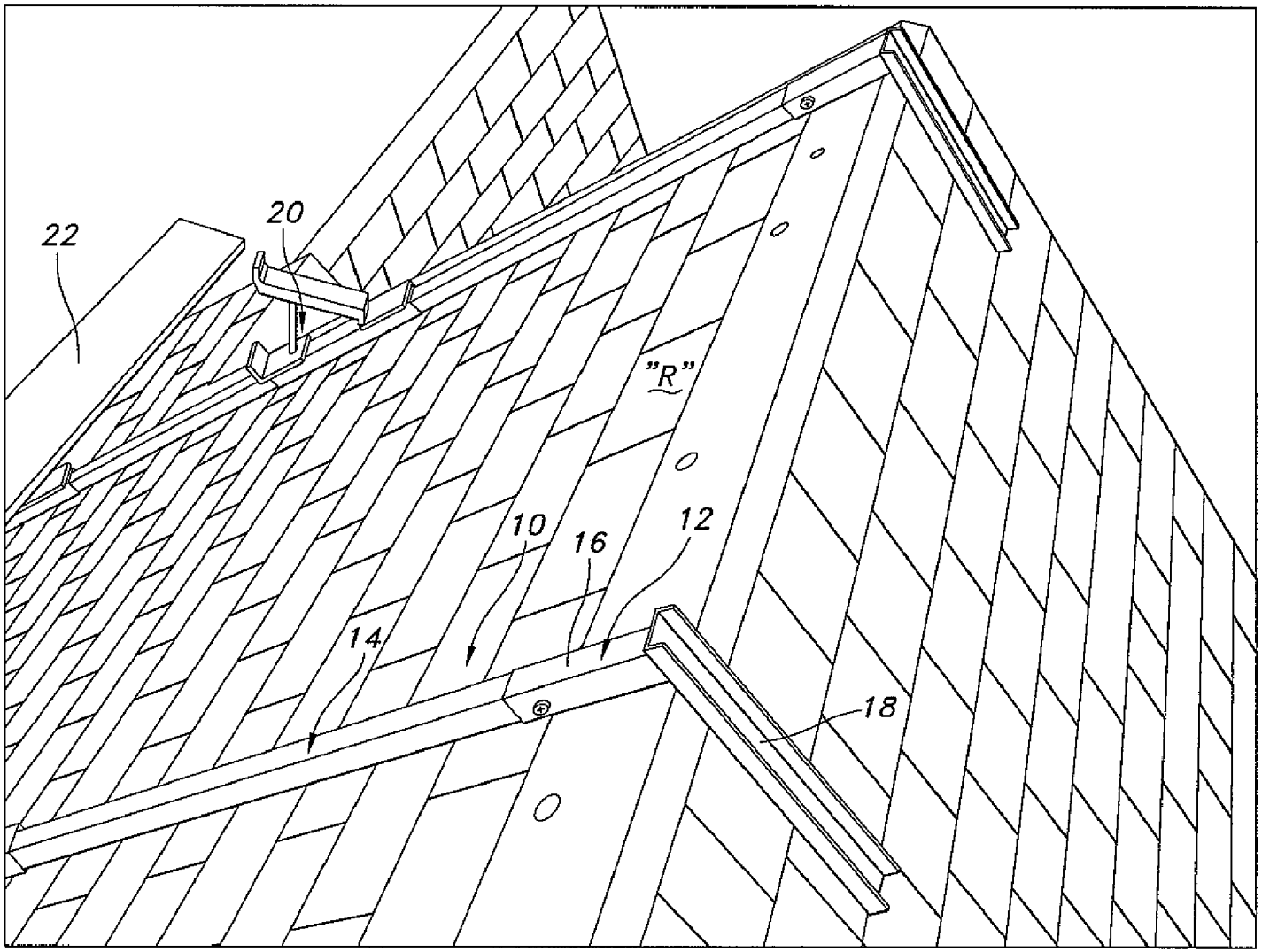
FIG. 1 is a photographic view of an exemplary scaffolding system according to the present disclosure mounted with respect to a roof structure.

With initial reference to FIG. 1, a pair of rail assemblies 10 are depicted in spaced relation with respect to a pitched roof "R". Each rail assembly 10 includes an elongated member/rail 14 and an L-shaped rail-mounting bracket 12 at an end thereof. Each L-shaped rail-mounting bracket 12 includes a hollow sleeve portion 16 and a bracket 18 that is substantially perpendicular thereto. The bracket 18 may be advantageously nailed to the roof surface so as to stabilize the rail assembly 10 with respect to roof "R". In nailing the bracket 18 to the roof surface, the hollow sleeve portion 16 may be space upward with respect to the apex of the roof. Downward with respect to the roof surface, a platform 22 is supported by a platform support member 20. Although not shown in FIG. 1, multiple platforms 22 may be positioned with respect to the roof "R", e.g., at approximately four foot spacings to facilitate roofing activities.

Figure 10:
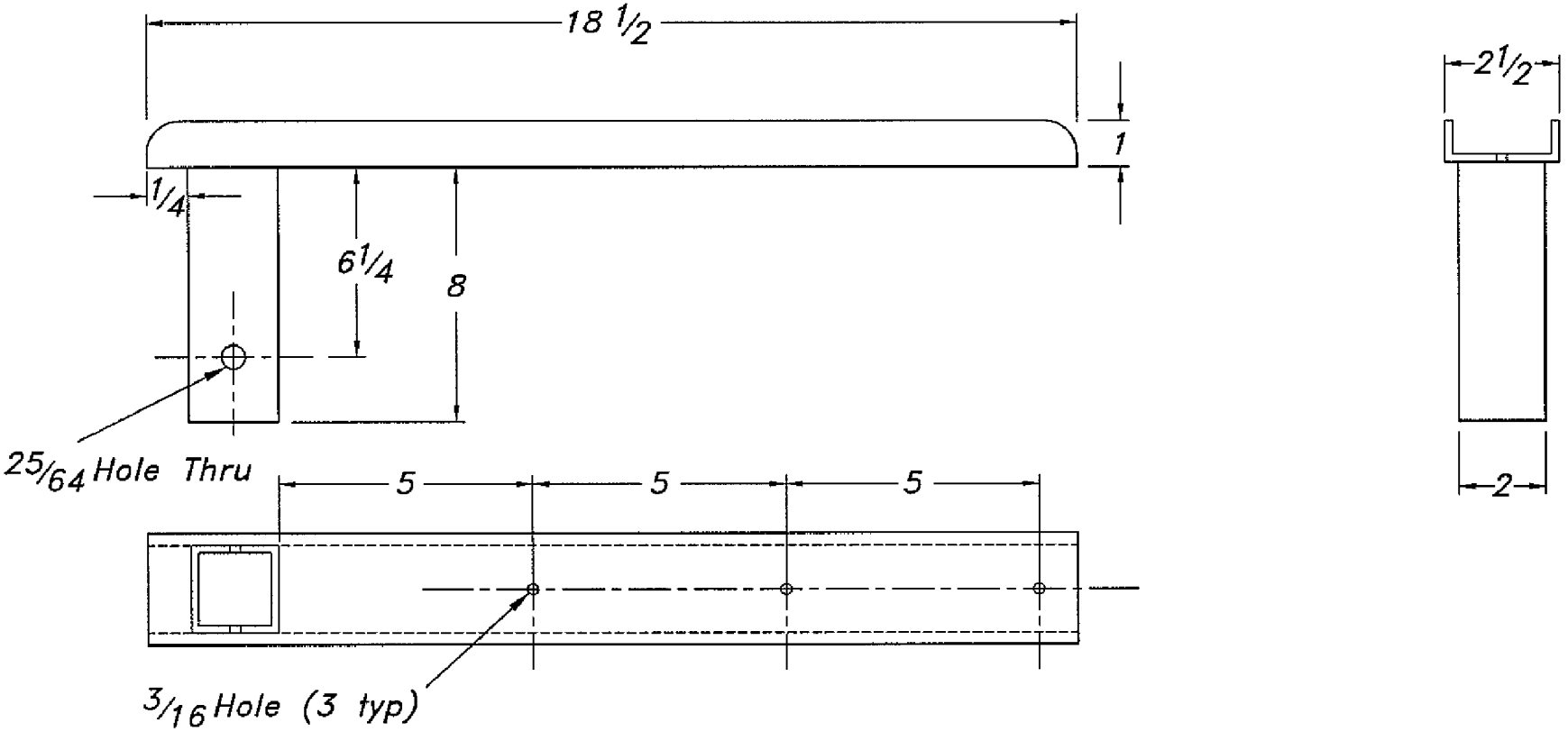
FIG. 10 are schematic views of an exemplary rail mounting bracket according to the present disclosure.

With particular reference to FIG. 10, additional details concerning an exemplary L-shaped rail-mounting bracket are shown. The bracket is typically fabricated from an material exhibiting appropriate strength and durability, e.g., a steel. The bracket portion advantageously defines a C-shaped cross-section for greater strength. Exemplary dimensions are shown in association with the schematic views of FIG. 10, although the present disclosure is not limited to such exemplary dimensions. The "25/64 hole thru" shown in the hollow sleeve portion of the L-shaped bracket is adapted to interact with a properly sized pin/bolt for securing the L-shaped bracket with respect to an elongated member/rail, as shown, for example, in FIG. 1.

Figure 2:
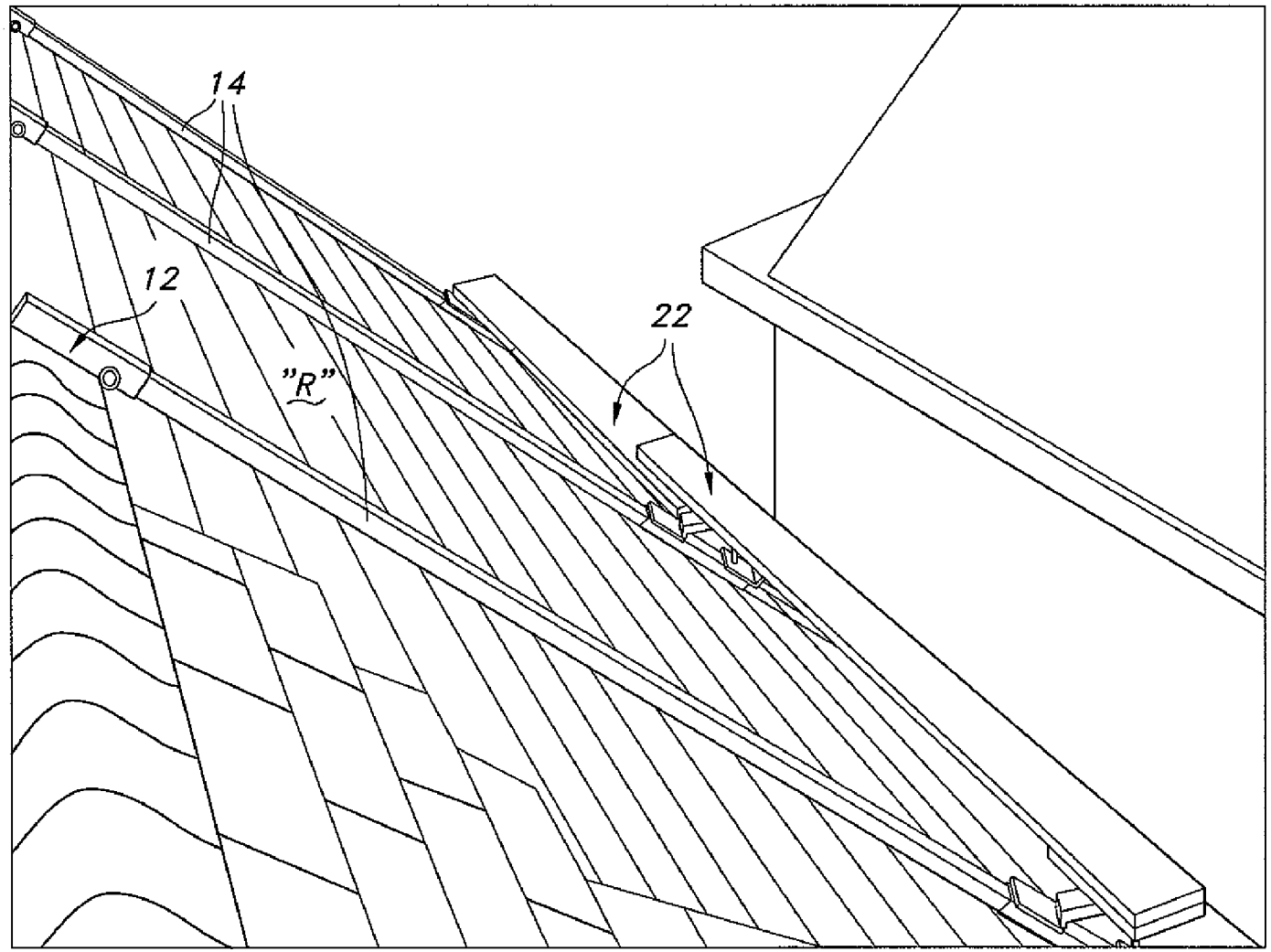
FIG. 2 is a photographic view of an exemplary scaffolding system according to the present disclosure mounted with respect to a roof structure.

Turning to FIG. 2, a further exemplary implementation of the disclosed scaffolding system is depicted. A plurality (three) rail assemblies 10 are mounted with respect to a roof surface "R". The rail assemblies 10 are supported with respect to the roof surface by L-shaped brackets 12 that cooperate with the roof apex. Bracket 18 is nailed to the roof surface, such nails being removable from the bracket/roof when the roofing job is complete. As shown in FIG. 2, the rail assemblies 14 are advantageously suspended above/away from the roof surface "R", such that roof shingles may be removed despite the presence of the rail assembly. Platforms 22 provide an extended work area for roofing personnel.

Figure 3:
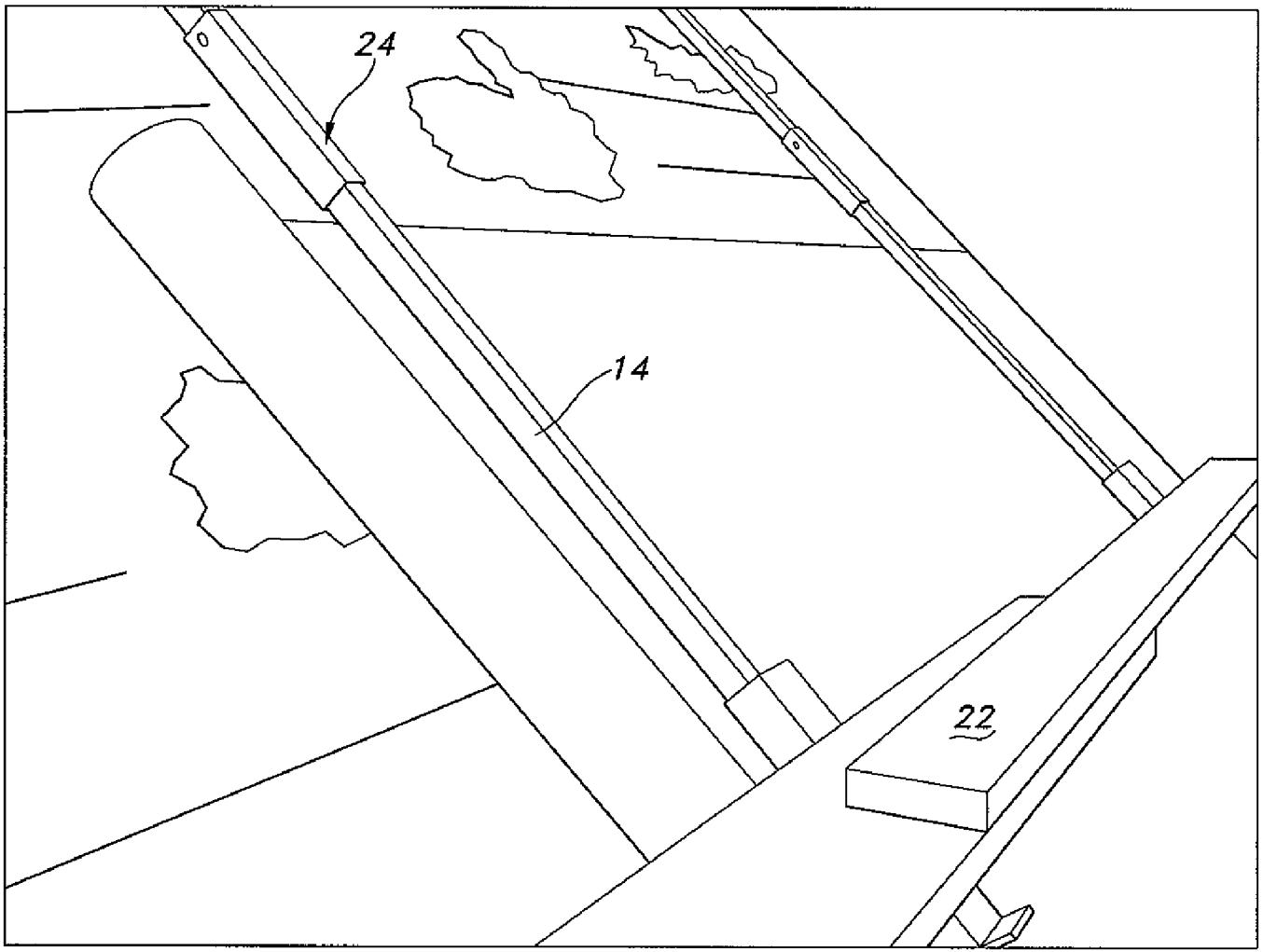
FIG. 3 is a photographic view of an exemplary scaffolding system according to the present disclosure mounted with respect to a roof structure.
Figure 4:
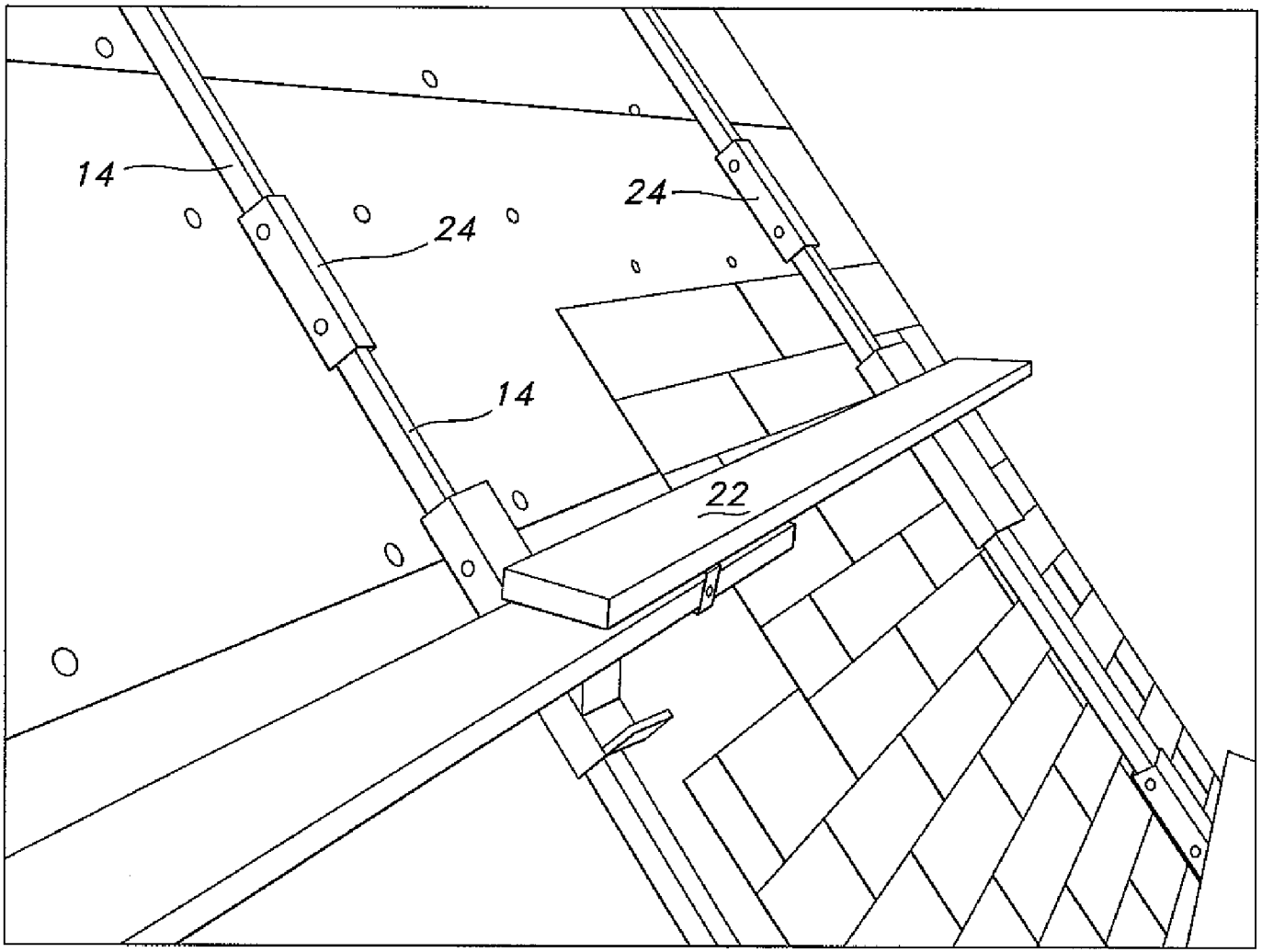
FIG. 4 is a photographic view of an exemplary scaffolding system according to the present disclosure mounted with respect to a roof structure.
Figure 5:
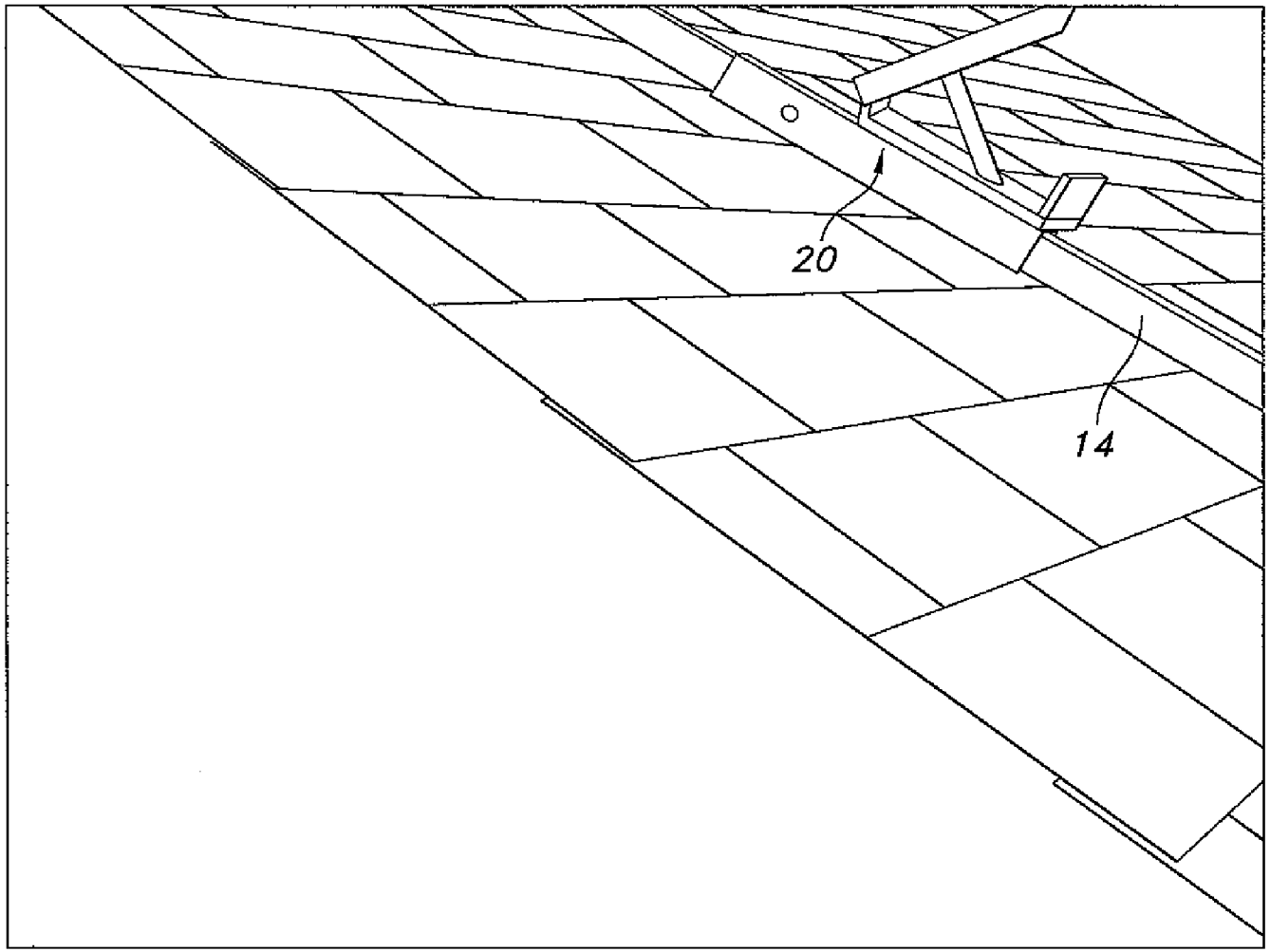
FIG. 5 is a photographic view of an exemplary scaffolding system according to the present disclosure mounted with respect to a roof structure.

Turning to FIGS. 3 and 4, additional views of exemplary scaffolding systems according to the present disclosure are provided. With particular reference to FIG. 4, sleeves/unions 24 join first and second elongated members/rails 14, thereby extending the effective length of elongated members/rails 14. Of note and as shown in FIGS. 3 and 4, the spaced positioning of rails 14 relative to the roof surface permit felt paper (FIG. 3) and shingle (FIG. 4) installation across the entire roof surface, including specifically the roof region positioned below and adjacent each of the rails 14. Indeed, spacing between the rails and the roof surface/roof deck is generally established through (i) interaction between brackets 12 and the roof apex, (ii) nesting sleeve(s)/union(s) 24 that bear against the roof surface/deck and create a clearance (e.g., 3/16") between the rail 14 and the roof deck, and/or (iii) one or more optional wood shaped wedges.

Figure 7:
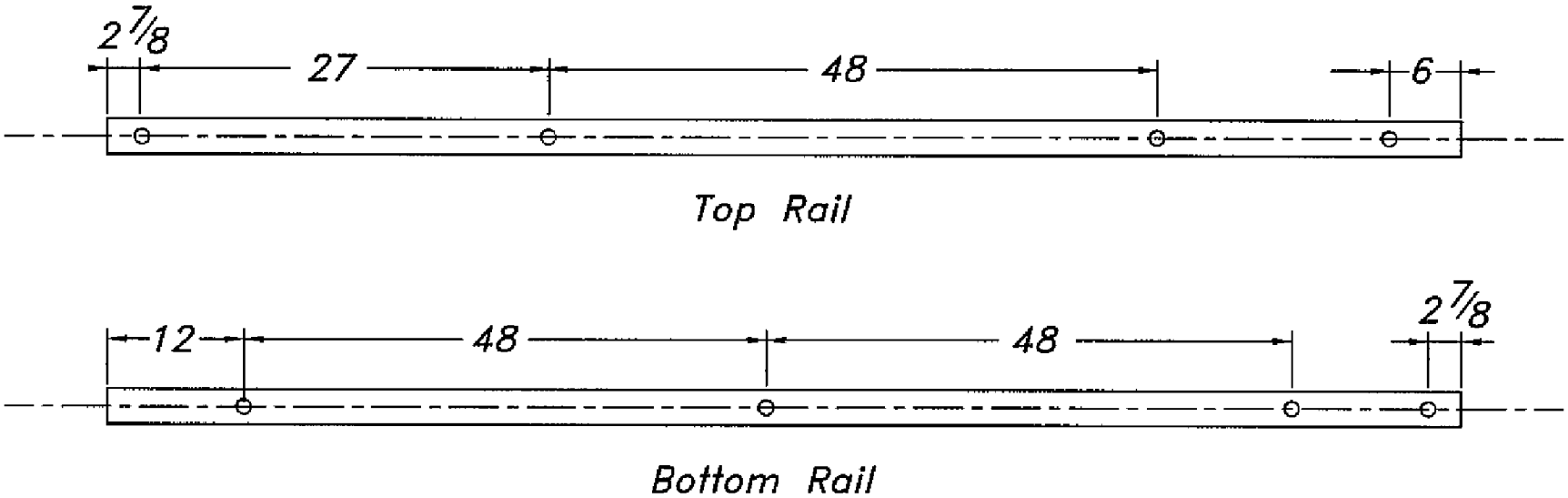
FIG. 7 are schematic drawings of exemplary rail members according to the present disclosure.
Figure 8:
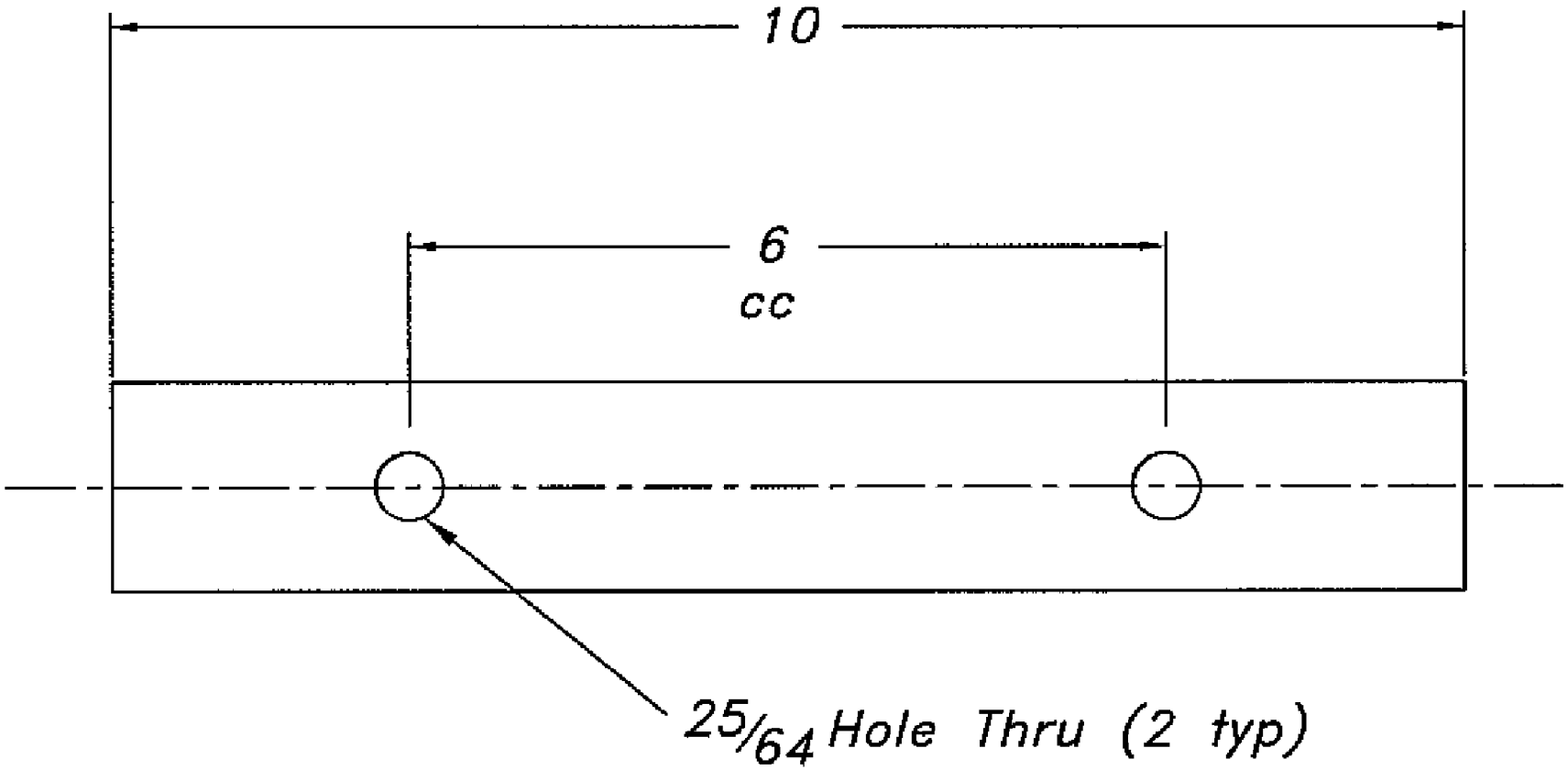
FIG. 8 is a schematic drawing of an exemplary rail joiner according to the present disclosure.
Figure 11:
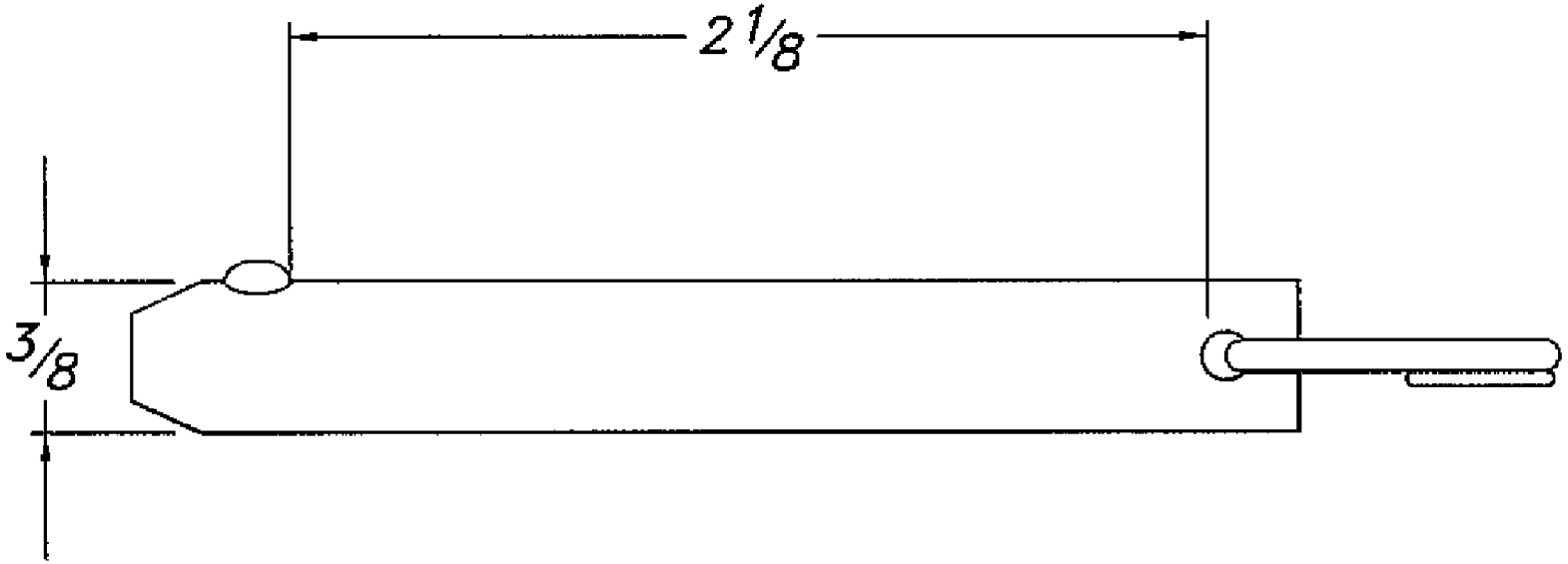
FIG. 11 is a schematic view of an exemplary assembly pin according to the present disclosure

As shown in FIG. 7, the elongated members/rails generally include a plurality of spaced apertures to facilitate interaction with associated componentry, i.e., L-shaped brackets and nesting sleeves/unions. Thus, the "top rail" is particularly adapted to cooperate with an L-shaped bracket (based on aperture positioning). In the exemplary dimensioning depicted in FIG. 7, the "top rail" includes an aperture that is positioned 2⅞ inches from the left end thereof, whereas the "bottom rail" includes an aperture that is positioned 2⅞ inches from the right end thereof. When the top and bottom rails are placed in an aligned orientation, the foregoing apertures are spaced by no less than 5¾ inches. With reference to FIG. 8, an exemplary "railjoiner" or nesting sleeve/union is depicted that includes first and second apertures that are spaced by 6 inches. This spacing accommodates/facilitates the joining of top and bottom rails with the nesting sleeve/union (railjoiner) in a telescoping position with respect thereto. An exemplary attachment pin is depicted in FIG. 11. In exemplary embodiments of the present disclosure, the rails and nesting sleeves/unions are fabricated from aluminum, thereby minimizing the weight while providing appropriate strength and durability. Alternative materials may be employed, as will be readily apparent to persons skilled in the art, e.g., steel or the like. The present disclosure is not limited to the dimensional values set forth in FIGS. 7, 8 and 11; rather, such dimensions are merely exemplary of potential implementations of the disclosed scaffolding system.

Figure 6:
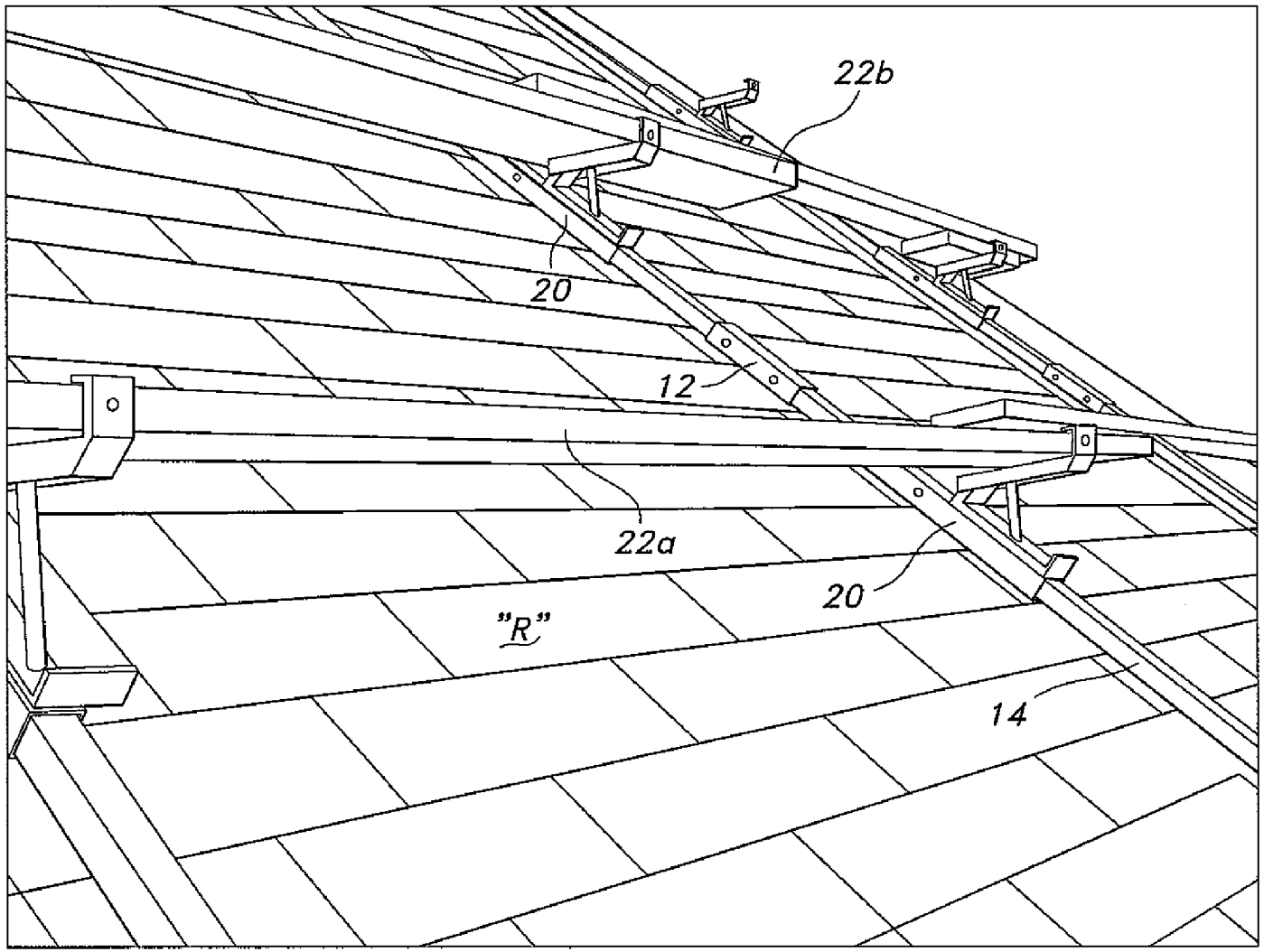
FIG. 6 is a photographic view of an exemplary scaffolding system according to the present disclosure mounted with respect to a roof structure.
Figure 9:
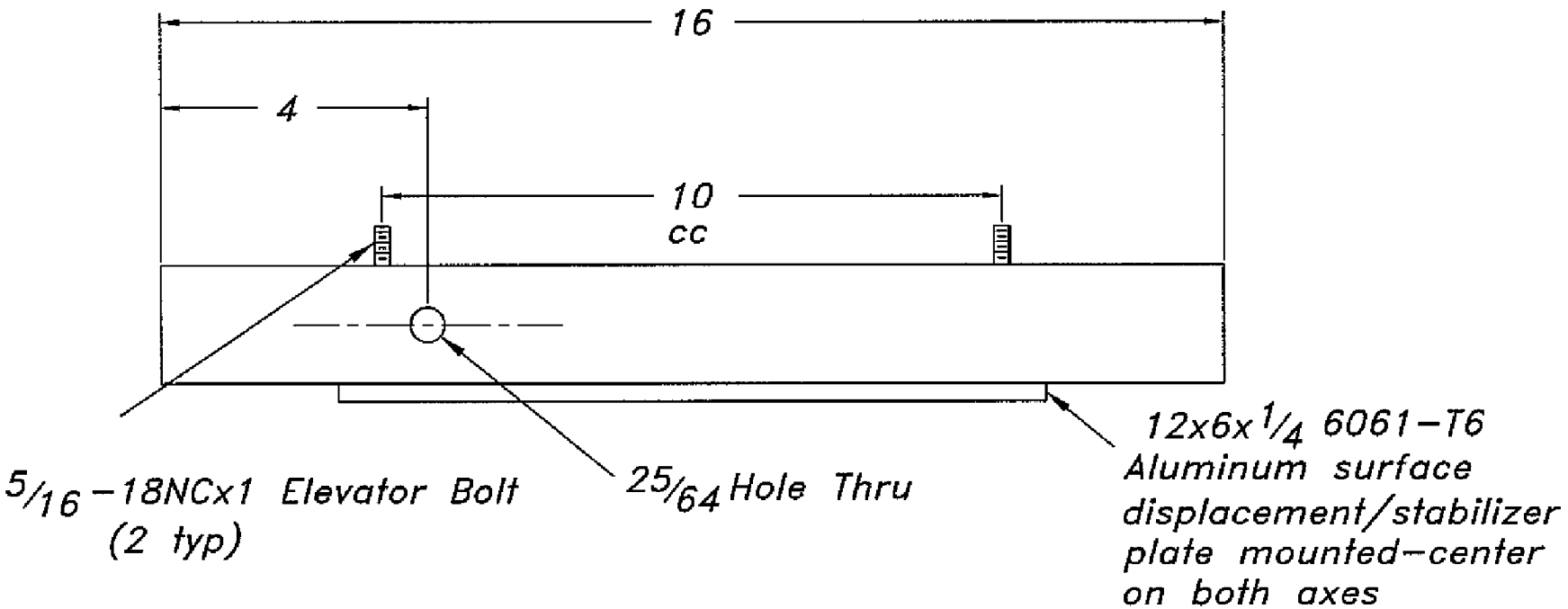
FIG. 9 is a schematic drawing of an exemplary kicker slide according to the present disclosure.

With reference to FIGS. 6 and 7, a further view of the disclosed scaffolding system mounted with respect to a roof surface "R" is provided. Exemplary platform support members/kicker slides 20 are visible in FIG. 6. As shown therein, multiple support members/kicker slides 20 may be slidingly mounted with respect to rails 14, thereby facilitating the support of multiple platforms 22*a*, 22*b*. Slides 20 space the rail assemblies away from the roof surface, thereby facilitating roofing activitiew. In addition, as shown in FIGS. 6 and 7, the shingling job is complete with the scaffolding system in place. Thus, roofing personnel are facilitated in completing the shingling job, both under and adjacent rails 14, due in part to the advantageous spacing away from the roof surface. An exemplary kicker slide member is depicted in FIG. 9 (the dimensions depicted therein are merely illustrative, and non-limiting).

In exemplary embodiments of the disclosed roof scaffolding system, roof mounting may be achieved without the use of nails, e.g., beyond the nails used in conjunction with bracket 18. In addition, height adjustments are quickly and easily achieved. Indeed, once deployed, height adjustments may generally be effected in less than a minute. For roof removal projects, i.e., "tear-offs", it is generally unnecessary to remove the scaffolding system prior to commencing the re-roofing process.

The disclosed scaffolding system provides a modular design that facilitates various activities, including tear-offs and roof repairs. The disclosed scaffolding system may be employed with a host of roofing materials and various roof pitches. Exemplary embodiments of the disclosed roof scaffolding system are of light-weight construction, e.g., aluminum, and offer substantial strength/durability for scaffolding applications.

Thus, the disclosed scaffolding system offers many advantageous features and functionalities. Although the disclosed scaffolding system has been described with reference to exemplary embodiments thereof, the present disclosure is not limited by or to such exemplary embodiments. Rather, the disclosed scaffolding system is susceptible to variations, modifications and/or enhancements without departing from the spirit or scope of the present disclosure. Accordingly, the present disclosure expressly encompasses such variations, modifications and/or enhancements as would be apparent to persons skilled in the art from the description provided herein.

The invention claimed is:

1. An adjustable scaffolding system, consisting of:

a. a first rail assembly that includes a first rail member having a rectangular cross section, a second rail member having a rectangular cross section, and a first union member having a rectangular cross section that receives the first and second rail members therein;

b. a first non-pivoting L-shaped bracket that includes a hollow sleeve portion having a rectangular cross section which receives an end of the first rail member of the first rail assembly, c. a first platform support member that includes a sleeve portion having a rectangular cross section which receives one of the first and second rail members and is movably mounted on the first rail assembly;

d. a second rail assembly is spaced relation relative to the first rail assembly, the second rail assembly including a third rail member having a rectangular cross section, a fourth rail member having a rectangular cross section, and a second union member having a rectangular cross section that receives the third and fourth rail members therein;

e. a second non-pivoting L-shaped bracket that includes a hollow sleeve portion having a rectangular cross section which receives an end of the third rail member of the second rail assembly, f. a second platform support member that includes a sleeve portion having a rectangular cross section which receives one of the third and fourth rail members and is movably mounted on the second rail assembly;

g. a platform that extends between and is supported by the first platform support member and the second platform support member;

wherein the first union member, the sleeve portion of the first platform support member and the hollow sleeve portion of the first non-pivoting L-shaped bracket rest against a roof surface to which the first rail assembly is mounted and function to space the first rail assembly away from such roof surface; and wherein the second union member, the sleeve portion of the second platform support member and the hollow sleeve portion of the second non-assembly pivoting L-shaped bracket rest against a roof surface to which the second rail assembly is mounted and function to space the second rail assembly away from such roof surface.

2. The adjustable scaffolding system according to claim 1, wherein the first rail member and the second rail member include apertures positioned so as to facilitate interaction with the first union member.

3. An adjustable scaffolding system, consisting of:

a. a first rail assembly that includes a first rail member having a rectangular cross section, a second rail member having a rectangular cross section, and a first union member having a rectangular cross section that receives the first and second rail members therein;

b. a first non-pivoting L-shaped bracket that includes a hollow sleeve portion having a rectangular cross section which receives an end of the first rail member of the first rail assembly, c. a first platform support member that includes a sleeve portion having a rectangular cross section which receives one of the first and second rail members and is movably mounted on the first rail assembly;

d. a second platform support member that (i) includes a sleeve portion having a rectangular cross section, (ii) which receives one of the first and second rail members and is movably mounted on the first rail assembly, and (iii) is spaced relative to the first platform support member along the first rail assembly;

e. a second rail assembly is spaced relation relative to the first rail assembly, the second rail assembly including a third rail member having a rectangular cross section, a fourth rail member having a rectangular cross section, and a second union member having a rectangular cross section that receives the third and fourth rail members therein;

f. a second non-pivoting L-shaped bracket that includes a hollow sleeve portion having a rectangular cross section which receives an end of the third rail member of the second rail assembly, g. a third platform support member that includes a sleeve portion having a rectangular cross section which receives one of the first and second rail members and is movably mounted on the second rail assembly;

h. a fourth platform support member that (i) includes a sleeve portion having a rectangular cross section, (ii) which receives one of the third and fourth rail members and is movably mounted on the second rail assembly, and (iii) is spaced relative to the third platform support member along the second rail assembly;

i. a first platform that extends between and is supported by the first platform support member and the third platform support member;

j. a second platform that extends between and is supported by the second platform support member and the fourth platform support member;

wherein the first union member, the sleeve portion of the first platform support member, the sleeve portion of the second platform support member and the hollow sleeve portion of the first non-pivoting L-shaped bracket rest against a roof surface to which the first rail assembly is mounted and function to space the first rail assembly away from such roof surface; and wherein the second union member, the sleeve portion of the third platform support member, the sleeve portion of the fourth platform support member and the hollow sleeve portion of the second non-pivoting L-shaped bracket rest against a roof surface to which the second rail assembly is mounted and function to space the second rail assembly away from such roof surface.

4. In combination:

a. a roof surface;

b. an adjustable scaffolding system mounted with respect to the roof surface, the adjustable scaffolding system including:

i. a first rail assembly that includes a first rail member having a rectangular cross section, a second rail member having a rectangular cross section, and a first union member having a rectangular cross section that receives the first and second rail members therein;

ii. a first non-pivoting L-shaped bracket that includes a hollow sleeve portion having a rectangular cross section which receives an end of the first rail member of the first rail assembly, iii. a first platform support member that includes a sleeve portion having a rectangular cross section which receives one of the first and second rail members and is movably mounted on the first rail assembly;

iv. a second rail assembly is spaced relation relative to the first rail assembly, the second rail assembly including a third rail member having a rectangular cross section, a fourth rail member having a rectangular cross section, and a second union member having a rectangular cross section that receives the third and fourth rail members therein;

v. a second non-pivoting L-shaped bracket that includes a hollow sleeve portion having a rectangular cross section which receives an end of the third rail member of the second rail assembly, vi. a second platform support member that includes a sleeve portion having a rectangular cross section which receives one of the third and fourth rail members and is movably mounted on the second rail assembly;

vii. a platform that extends between and is supported by the first platform support member and the second platform support member;

wherein the first union member, the sleeve portion of the first platform support member and the hollow sleeve portion of the first non-pivoting L-shaped bracket rest against the roof surface to which the first rail assembly is mounted and function to space the first rail assembly away from the roof surface; and wherein the second union member, the sleeve portion of the second platform support member and the hollow sleeve portion of the second non-pivoting L-shaped bracket rest against the roof surface to which the second rail assembly is mounted and function to space the second rail assembly away from the roof surface.

* * * * *